US009731867B2

(12) United States Patent
Corbeil

(10) Patent No.: US 9,731,867 B2
(45) Date of Patent: Aug. 15, 2017

(54) CONTAINER ARRANGEMENT FOR PRODUCT

(71) Applicant: CORPACK GMBH, Munich (DE)

(72) Inventor: Jean Paul Corbeil, Munich (DE)

(73) Assignee: CORPACK GMBH, Munich (DE)

( * ) Notice: Subject to any disclaimer, the term of this patent is extended or adjusted under 35 U.S.C. 154(b) by 0 days.

(21) Appl. No.: 14/650,588

(22) PCT Filed: Dec. 11, 2013

(86) PCT No.: PCT/EP2013/076277
§ 371 (c)(1),
(2) Date: Jun. 9, 2015

(87) PCT Pub. No.: WO2014/090897
PCT Pub. Date: Jun. 19, 2014

(65) Prior Publication Data

US 2015/0344185 A1 Dec. 3, 2015

(30) Foreign Application Priority Data

Dec. 12, 2012 (DE) ..... 10 2012 112 195
Dec. 12, 2012 (DE) ..... 20 2012 104 848 U

(51) Int. Cl.
*B65D 1/04* (2006.01)
*B65D 1/06* (2006.01)
(Continued)

(52) U.S. Cl.
CPC ..... *B65D 25/38* (2013.01); *B65D 11/20* (2013.01); *B65D 21/0204* (2013.01);
(Continued)

(58) Field of Classification Search
CPC ..... B65D 1/04; B65D 1/06; B65D 21/0209; B65D 21/0237; B65D 81/3222;
(Continued)

(56) References Cited

U.S. PATENT DOCUMENTS 3,856,138 A * 12/1974 Maekawa ..... B65D 81/3222 206/221
4,673,094 A 6/1987 Mednis
6,145,685 A * 11/2000 Dick ..... B65D 77/0486 215/10

FOREIGN PATENT DOCUMENTS

AU 475148 B2 2/1975
DE 202005008852 U1 11/2006
(Continued)

*Primary Examiner* — Andrew T Kirsch
(74) *Attorney, Agent, or Firm* — Karl F. Milde, Jr.; Eckert Seamans Cherin & Mellott, LLC

(57) ABSTRACT

A container arrangement for product comprises at least one first independent container part having a closable dispensing opening and a second independent container part having a closable dispensing opening. The second container part can be arranged detachably in a recess of the first container part in such a manner that the first container part and the second container part are connected to form the container arrangement, wherein the first dispensing opening and the second dispensing opening point in different directions. The first dispensing opening can be closed by a first closure part and the second dispensing opening can be closed by a second closure part. At least the second closure part overlaps a subregion of the second container part and a subregion of the first container part in a locking manner.

21 Claims, 8 Drawing Sheets

(51) Int. Cl.

| | |
|---|---|
| ***B65D 21/02*** | (2006.01) |
| ***B65D 81/32*** | (2006.01) |
| ***B65D 6/28*** | (2006.01) |
| ***B65D 8/18*** | (2006.01) |
| ***B65D 25/38*** | (2006.01) |
| ***B65D 6/00*** | (2006.01) |
| ***B65D 43/14*** | (2006.01) |

(52) U.S. Cl.
CPC ..... *B65D 21/0231* (2013.01); *B65D 43/14* (2013.01); *B65D 81/3216* (2013.01)

(58) Field of Classification Search
CPC ..... B65D 81/3227; B65D 81/3283; B65D 81/3288; B65D 21/0204
USPC ..... 220/4.21
See application file for complete search history.

(56) References Cited

FOREIGN PATENT DOCUMENTS

| | | | |
|---|---|---|---|
| EP | 0145425 | A2 | 11/1984 |
| JP | 2007055681 | A | 3/2007 |
| WO | 2011116442 | A1 | 9/2011 |

* cited by examiner

CONTAINER ARRANGEMENT FOR PRODUCT

BACKGROUND OF THE INVENTION

The present invention relates to a container arrangement for a product, comprising at least two independent container parts each having at least one closable dispensing opening of its own.

Known from DE 10 2010 052 225 A1 is a container arrangement comprising a first and a second container part. Each container part has a separate dispensing opening. The container parts can be connected to one another in such a manner that the dispensing opening of the first container part points in a first direction and the dispensing opening of the second container part points in a second direction.

Known from EP 0948448 is a container arrangement which comprises two container parts which can be emptied by a common dispensing opening. The two container parts are connected to one another in a separable manner. In the connected state they form a uniform bottle. The product of the two container parts can only be emptied via a common opening where a problem consists in that the two products of the two container parts can be mixed in an undesirable manner during the dispensing process.

SUMMARY OF THE INVENTION

The principal object of the present invention is to provide a container arrangement which comprises at least two container parts that can be connected to one another in a simple manner, where at the same time the products of the container parts can also be dispensed separately from one another even in the connected state.

This object, as well as other objects of the invention which will occur to those skilled in the art, are achieved by providing a container arrangement for a product which comprises at least one first independent container part with a closable dispensing opening and a second independent container part with a closable dispensing opening, where the second container part can be disposed detachably in a recess of the first container part in such a manner that the first container part and the second container part can be connected to form the container arrangement. The first dispensing opening and the second dispensing opening point in different directions. The first dispensing opening can be closed by a first closure part and the second dispensing opening can be closed by a second closure part. At least the second closure part at the same time overlaps a subregion of the second container part and the first container part in a locking manner when the first and the second container part are connected to one another.

The essential advantage of the container arrangement according to the invention consists in that the two container parts can be connected rapidly and simply to one another so that depending on application and handling, they can be transported and handled jointly together as a unit and separately from one another. In this case, for the locking it is merely necessary to insert or slide the second container part into the recess of the first container part and attach or place the closure part of the second container part thereon.

The two container parts of the present container arrangement are preferably suitable for receiving solid, liquid, gel-like, pasty or even gaseous substances. For example, the following combinations can be contained in the container parts of a container arrangement: shampoo-rinse, shampoo-shower gel, shower gel-exfoliate, baby oil-baby lotion, sun cream-after-sun cream, mustard-ketchup, mustard—mayonnaise.

According to one advantage of the present invention, it is feasible to configure differently the container parts of the present container arrangement by means of different features, e.g. by means of colour, labelling and transparency to make the products contained in the container parts visually identifiable and indicate the respective contents.

Advantageously the container parts of the present container arrangement can also have different shapes and sizes depending on the application. In this case it is possible that the interconnected container parts overall have the shape and design of a product already established on the market. In this way, a harmonious adaptation to each already existing design can be made and it can be avoided that purchasers used to specific shapes and sizes of products must reorientate and become used to new shapes and sizes.

Since the dispensing openings of the two container parts of the present container arrangements point in different directions, in particular lie opposite along the longitudinal axis of the container arrangement, the container parts can also be compressed and emptied independently of one another when the container parts are connected to one another. In this case variously large pressures can be applied to the container parts depending on contents or product. Advantageously the container parts can consist of different materials and/or different material thicknesses so that in particular the squeezability of the material or the respective container part for dispensing the product can be different. As a result, the pressure to be exerted for dispensing can be matched individually to the product contained in a container part in each case or to its viscosity. The container parts can have different dimensions or volumes so that it is feasible to coordinate material components contained in the container parts which are to be mixed with one another in predefined ratios after dispensing. In order to facilitate a particularly easy dispensing of a particularly viscous product, the container part containing this product can be placed with its closure part on a corresponding placement surface.

Advantageously the present invention makes it possible that trademark designations, product information or advertising information on the products contained in the container parts are applied to only one side of the container so that the presentation of the products on the shelf of the reseller is visually appreciably simplified and improved.

Advantageous embodiments of the invention are obtained from the subclaims. In a particularly advantageous further development of the invention, the container arrangement has a uniformly closed cross-section, preferably a cylindrical cross-section when the first container part is connected to the second container part. Expediently the first dispensing opening and the second dispensing opening of a present particularly easy-to-handle container arrangement are disposed coaxially to one another. In order to produce an overall particularly stable container arrangement, the second container part is preferably fastened in the recess with the aid of positive and/or non-positive and/or firmly bonded locking elements.

In a preferred embodiment of the invention, the first container part has a wall which partially delimits the recess and the second closure part comprises a locking arrangement which acts in a locking manner on a locking arrangement disposed at an end region of the wall of the first container part and on a locking arrangement disposed on the wall of the second container part when the second container part is inserted in the recess of the first container part and when the closure part is disposed on the dispensing opening of the second container part. At the same time, the locking arrangement of the second closure part particularly preferably has the form of at least one locking projection disposed on the inner side of the second closure part (or at least one locking groove) and the locking arrangement of the wall has the form of at least one locking groove disposed on the outer side of the wall (or at least one locking projection). The locking arrangement of the wall of the second container expediently has the form of at least one locking groove disposed on the outer side of the wall of the second container part (or at least one locking projection).

In a further advantageous embodiment of the invention, the recess extends from the side of the first closure part to the side of the second closure part and the first closure part of the first container part comprises a locking arrangement which acts in a locking manner on a further locking arrangement disposed at the end region of the wall of the first container part and on a further locking arrangement disposed on the wall of the second container part when the second container part is inserted in the recess of the first container part and when the first closure part is disposed on the dispensing opening of the first container part.

In a further embodiment of the invention, the first container part comprises leg parts which delimit the recess and which are opposite in relation to the longitudinal axis of the first container and the second closure part comprises a locking arrangement which acts in a locking manner on locking arrangements disposed on the end regions of the leg parts and on a locking arrangement disposed on the second container part when the second container part is inserted in the recess of the first container part and when the second closure part is disposed on the dispensing opening of the second container part. In this case the locking arrangement of the second closure part and the locking arrangements of the leg parts as well as the locking arrangement of the second container part preferably form a snap or screw closure which is particularly easy to handle.

In a preferred further development of the invention, the first container part has an auxiliary container part between the leg parts, which partially fills the recess between the leg parts of the first container part and which engages in an indentation of the second container part which is formed between the first leg part and a second leg part which lies opposite to this in relation to the longitudinal axis of the container arrangement when the first container part is connected to the second container part.

In another further development of the invention, the second container part also has an auxiliary container part between the leg parts thereof, which partially fills the recess between the leg parts of the second container part and which engages in the recess of the first container part when the first container part is connected to the second container part.

It is particularly advantageous if in the preceding explained embodiments of the present container arrangement in which the second container part has leg parts, the first closure part possesses a locking arrangement which acts in a locking manner on the locking arrangements disposed on the end regions of the leg parts of the second container part and on the first container part when the second container part is inserted in the recess of the first container part and when the first closure part is disposed on the dispensing opening of the first container part. With corresponding configurations and dimensioning of the two container parts, both container parts can advantageously be manufactured cost-effectively using one and the same shape from a plastic material.

In a further preferred embodiment of the present container arrangement, the recess of the first container part into which the second container part can be inserted is disposed laterally next to an extension part of the first container part, and the second container part has an extension part which engages in a further recess of the first container part. The extension part of the first container part engages at the same time in a further recess of the second container part when the first container part and the second container part are connected to one another. The extension part of the first container part has a locking arrangement on its end region facing the second closure part which acts in a locking manner on the locking arrangement of the second closure part and the second container part has a locking arrangement which acts in a locking manner on the locking arrangement of the second closure part when the second closure part of the second container part is disposed on the dispensing opening of the second container part. At the same time, the extension part of the second container part has a locking arrangement on its end region facing the first closure part which acts in a locking manner on the locking arrangement of the first closure part and has a locking arrangement on the first container part which acts in a locking manner on the locking arrangement of the first closure part when the first closure part of the first container part is disposed on the dispensing opening of the first container part.

In a further preferred embodiment of the present container arrangement, the locking arrangement of the second closure part has the form of at least one locking projection disposed on the inner side of the second locking part or at least one locking groove and that the locking arrangement of the leg parts or the extension part of the first container part has the form of at least one locking groove disposed on the outer sides of the leg parts or on the outer sides of the extension part of the first container part or of at least one locking projection. Furthermore the locking arrangement of the first closure part has the form of at least one locking projection disposed on the inner side of the first closure part or at least one locking groove and the locking arrangement of the leg parts or of the extension part of the second container part has the form of a locking groove disposed on the outer sides of the leg parts of the second container part or on the outer side of the extension part of the second container part or of at least one locking projection. The further recesses or the extension parts can lie opposite in relation to the longitudinal axis of the container arrangement or the extension parts (5-5, 5-25) or they can alternatively be offset with respect to one another by 90° when the first container part is connected to the second container part. Even in these container arrangements comprising extension parts, the container parts can be dimensioned so that they are identical and can be produced from a plastic material using one and the same mould.

In order to enable a particularly stable connection of the two container parts, the second container part can have fixing elements on its side facing the first container part and the first container part can have fixing elements on its side facing the second container part which prevent a displacement of the first and second container part transversely to the longitudinal axis of the container arrangement. These fixing elements can preferably have the form of fixing slopes which abut against one another or of axially intermeshing projections and indentations.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
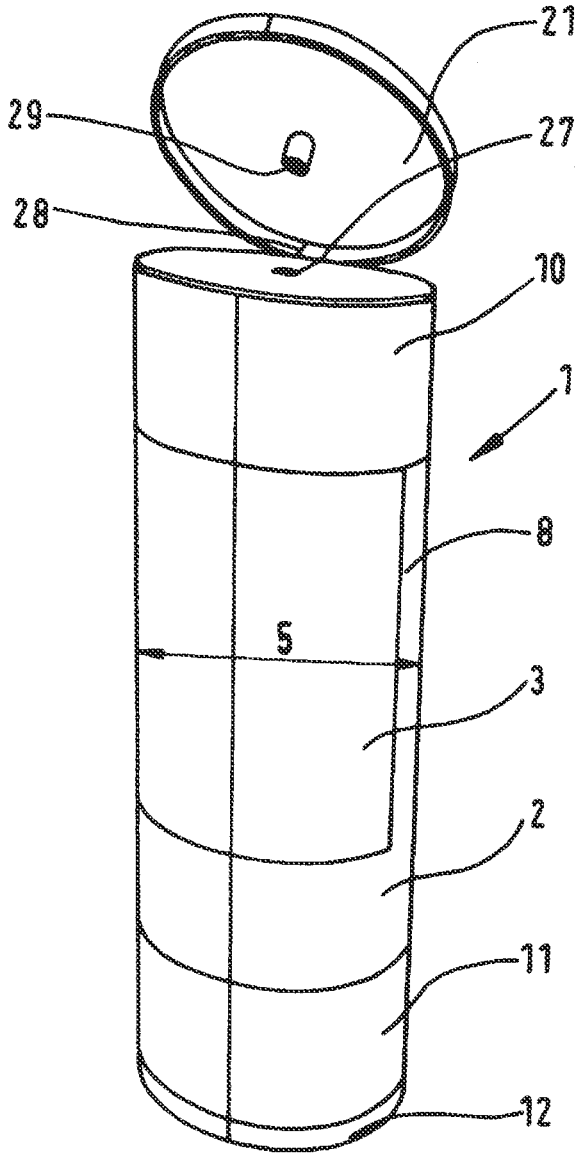
FIGS. 1 to 3 show a first preferred embodiment of the container arrangement according to the invention.

Firstly a general embodiment of the present invention is explained in detail in connection with FIGS. 1 to 3. Accordingly the present container arrangement 1 comprises a container part 2 and a container part 3. Closure parts 10 or 11 are disposed on the respective faces of the container parts 2 and 3. The closure part 10 has a lid part 21 on its face. Accordingly the closure part 11 has a lid part 12 on its face. The container part 3 is disposed in an indentation or recess 8 of the container part 2. The two assembled container parts 2 and 3 form the container arrangement 1 which preferably has a uniform closed cross-section 5. Preferably the container parts 2 and 3 are disposed opposite by about 180° and coaxially with respect to one another.

In a preferred embodiment of the invention, the closure part 10 and the closure part 11 each have a central opening 27 as is shown in FIG. 1 for the closure part 10. Through this opening 27 it is possible to dispense the product from the interior of the container part 2 or 3. The lid part 12 or 21 is preferably fastened pivotably to the closure part 10 or 11 by means of the assistance of a hinge part 27. A peg-shaped stopper part 29 is preferably disposed in each case at the centre of the lid part 12 or 21 on the side of the lid part 12 or 21 facing the closure part 10 or 11, which stopper part engages in the opening 27 of the closure part 10 or 11 in the closed state of the lid part 12 or 21 in order to close the container part 2 or 3 in a sealing manner.

The container arrangement 1 overall has a cylindrical, preferably circular cylindrical shape. For mounting it can be placed perpendicularly onto the face of the lid part 12 or 21. Other cross-sectional shapes, in particular cylindrical cross-sectional shapes such as, for example, rectangular or oval cross-sectional shapes are feasible.

Figure 2:
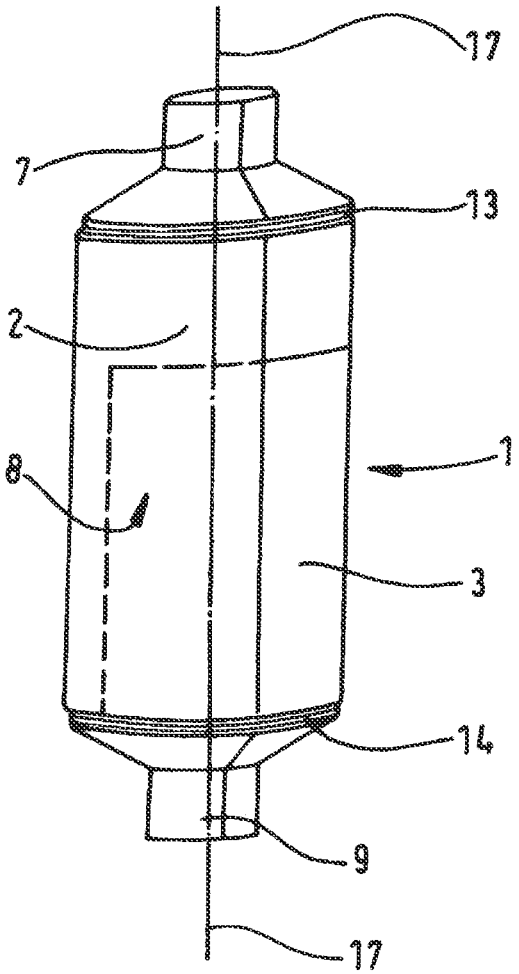

FIGS. 1 and 2 show the container parts 2 and 3 in the interconnected state forming the container arrangement 1. In this case, the container part 3 is disposed in the recess 8 of the container part 2 where the wall of the container part 3 can be connected positively and/or non-positively and/or in a firmly bonded manner to the wall of the recess 8 of the container part 2. The reference number 22 (FIG. 3) merely designates as an example locking elements which are used for non-positive locking of the container part 3 on the container part 2.

The container part 2 according to FIG. 2 has a dispensing opening 7 which is offset by 180° with respect to the dispensing opening 9 of the container part 3. Preferably the dispensing openings 7 and 9 are disposed coaxially with respect to one another. Located on the external circumference of the container 2 is a locking arrangement which can bring about a connection between the closure part 10 and the container part 2. The locking arrangement preferably has the form of a locking groove 13 which runs in the circumferential direction of the container part 2. For connection of the closure part 10 to the container part 2, locking projections (not shown) are preferably disposed on the inner side of the closure part 10 which can engage or snap into the locking groove 13 of the container part 2. Other locking arrangements, e.g. screw or snap connections, are feasible.

The dispensing opening 9 of the container part 3 has a locking arrangement, preferably also a locking groove 14 which extends in the region of the dispensing opening 9 on the external circumference of the container arrangement 1 partially over the container part 3 and partially over the container part 2 in the circumferential direction. It is thereby achieved that when fastening the closure part 11 according to FIG. 1, the two container parts 2 and 3 are automatically firmly connected to one another when the container part 3 is inserted into the recess 8 of the container part 2. Other connecting arrangements, e.g. screw or snap connections are feasible if they fulfill the explained function.

Figure 3:
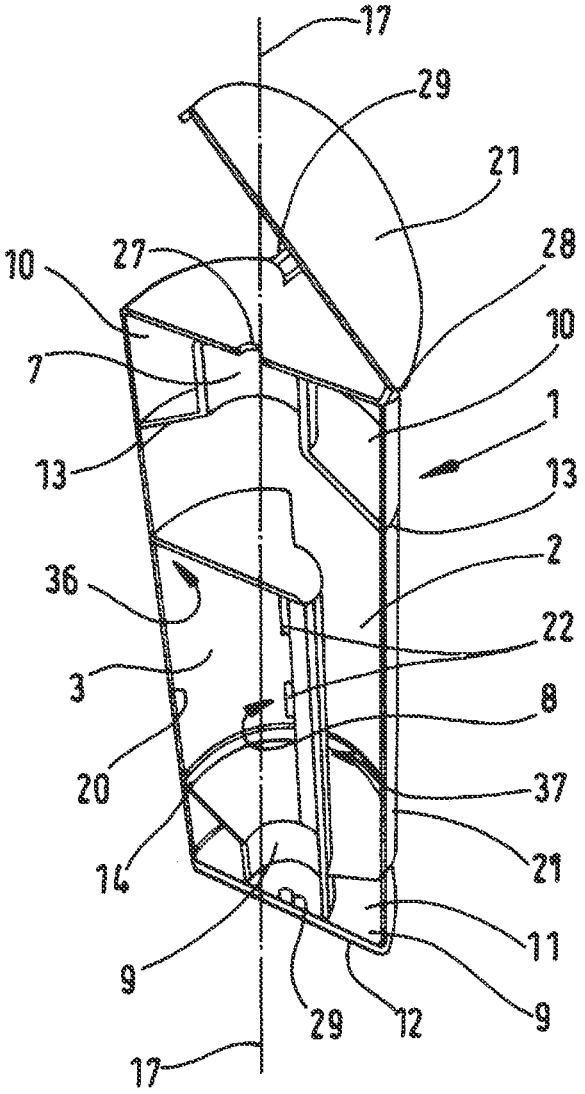

FIG. 3 shows a longitudinal section along the longitudinal axis 17 of the container arrangement 1. The container part 3 is disposed in the recess 8 of the container part 2. In this case, the section or circumference 36 of the wall part 20 of the container part 2 abuts against the complementary section 37 of the wall 21 of the container part 3. It can be identified that the closure parts 10 and 11 overlap the dispensing openings 7 or 9 of the container parts 2 or 3 and that the already explained locking grooves 13 and 14 extend radially to the longitudinal axis 17 of the container arrangement 1 along the external circumference of the container part 2 (locking groove 13) and on the external circumference of the container part 3 and of the container part 2 (locking groove 14). Since the container arrangement 1 comprises the container parts 2 and 3 in the region of the dispensing opening 9, the locking groove 14 extends radially to the longitudinal axis 17 of the container arrangement 1 along the wail parts 20 and 21. It is also feasible that in a further development of the invention the recess 8 extends over the entire length of the container part 2 and that the container part 3 according to the explained locking in the region of the closure part 11 is also locked in the region of the closure part 10.

According to FIGS. 4*a* to 4*d*, a more special embodiment of the container arrangement 1-1 according to the invention comprises a first container part 1-2, a second container part 1-3 as well as a first closure part 1-10 and a second closure part 1-11.

The first container part 1-2 comprises a recess 1-4 in which the second container part 1-3 can be inserted in such a manner that the two container parts 1-2 and 1-3 form the container arrangement 1-1 with preferably a shaped body having a uniform cross-section. The recess 1-4 of the first container part 1-2 is in this case formed by two leg parts 1-5 and 1-6 spaced apart from one another transversely to the longitudinal direction of the first container part 1-2, where the leg parts 1-5 and 1-6 are interconnected on the side facing the dispensing opening 1-7 (FIG. 4*c*) of the first container part 1-2 by a connecting region 1-8 of the first container part 1-2. The recess 1-4 is open towards the side facing away from the dispensing opening 1-7 in such a manner that the container part 1-3 can be slid into the recess 1-4 from this side. The second container part 1-3 when viewed in the direction of insertion has a dispensing opening 1-9 (FIG. 4*c*) on its side facing away from the dispensing opening 1-7 of the first container part 1-2.

On its side facing the first container part 1-2, the second container part 1-3 preferably has fixing slopes 1-15 in the manner apparent in particular from FIGS. 1*b* and 1*c* which then, when the container part 1-3 is inserted completely into the recess 1-4 of the container part 1-2, each act on a fixing slope 1-17 of the first container part 1-2 formed complementary to a fixing slope 1-15. The fixing slopes 1-17 are in particular apparent from FIG. 1*d*. The fixing slopes 1-15 and the associated fixing slopes 1-17 then prevent the two container parts in the region of the fixing slopes 1-15 and 1-17 being displaced with respect to one another transversely to the longitudinal axis of the container parts 1-2 and 1-3 when the second container part 1-3 is inserted completely into the first container part 1-2. It is pointed out that instead of the fixing slopes 1-15 and 1-17, other fixing devices can also be provided. For example, the end of the second container part 1-3 facing the first container part 1-2 can be configured to be conical and engage in a corresponding indentation of the first container part 1-2.

The dispensing opening 1-7 of the first container part 1-2 can be closed by the closure part 1-10. In corresponding manner the dispensing opening 1-9 of the second container part 1-3 can be closed by the closure part 1-11.

The closure part 1-10 can be fastened with the aid of a connecting arrangement, preferably a snap closure on the first container part 1-2. To this end the first container part 1-2 preferably has on its side facing the closure part 1-10 a locking groove 1-13 running in the circumferential direction (FIG. 4) in which locking projections 1-19 located on the internal circumference of the preferably annularly configured closure part 1-10 can engage for locking the closure part 1-10. It is pointed out that it is also possible to provide the locking projections on the container part 1-2 and the locking groove on the closure part 1-10. Other locking devices such as, for example, screw and snap connections are also feasible in this region.

Figures 4A, 4B, 4C, 4D:
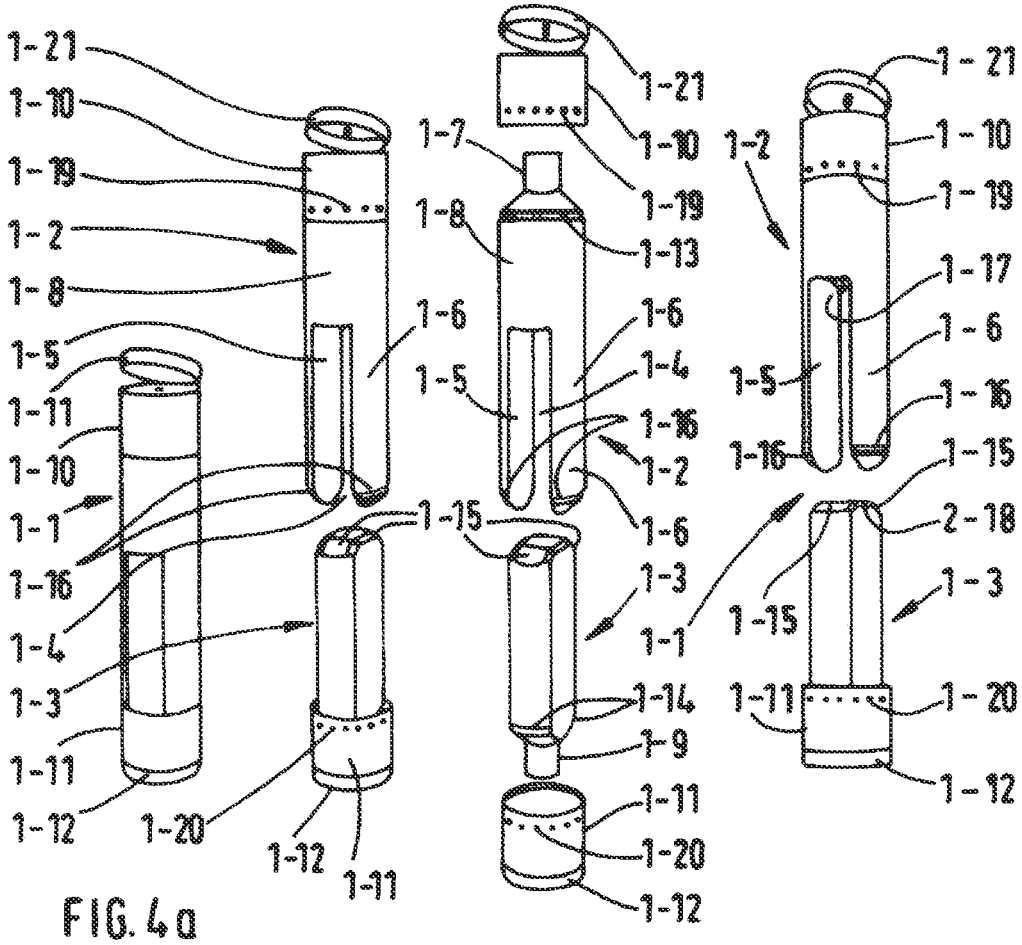
FIGS. 4*a* to 4*d* show a second preferred embodiment of the container arrangement according to the invention in which one container part is received substantially completely in a recess of the other container part.

In corresponding manner locking grooves 1-14 running in the circumferential direction are located on the container part 1-3 on its side facing the closure part 1-11 and locking grooves 1-16 which also run in the circumferential direction are located on the end regions of the sides of the leg parts 1-5 and 1-6 facing the container part 1-3. The locking grooves 1-14 and 1-16 are preferably configured such that when the second container part 1-3 is inserted completely in the first container part 1-2, they overall form a circumferential groove in which locking projections 1-20 located on the inner side of the preferably annularly configured closure part 1-11 engage for locking the closure part 1-11. An essential advantage of the invention consists in that the second container part 1-3 is automatically locked on the first container part 1-2 when it is completely inserted into the first container part 1-2 and the locking projections 1-20 engage in the locking grooves 1-14 and 1-16 aligned with respect to one another to form a circumferential groove upon closure of the dispensing opening 1-9 (FIG. 4*c*). It is pointed out that it is also possible to provide the locking projections 1-20 on the leg parts 1-5 and 1-6 and the locking grooves 1-16 on the closure part 1-11. Other locking devices such as, for example, screw and snap connections are also feasible in this region.

A further embodiment of the container arrangement 2-1 according to the invention is explained hereinafter in connection with FIGS. 5*a* to 5*c* in which the container part 2-2 substantially corresponds to that of the container arrangement of FIGS. 4*a* to 4*c*. The container part 2-2 only differs from the container part 1-2 of FIGS. 4*a* to 4*c* in that the recess 2-4 between the leg parts 2-5 and 2-6 of the container part 2-2 is partially filled by an auxiliary container part 2-22 which encloses a volume which is in communication with the volume of the container part 2-2. In this way, it is achieved that the container part 2-2 comprises a larger total volume than that of the container part 1-2 of FIGS. 4*a* to 1*d*.

In order to enable the connection of the container parts 2-2 and 2-3, the container part 2-3 has an indentation 2-21 in which the auxiliary container part 2-22 is completely received when the container parts 2-2 and 2-3 are connected to one another. The arrangement of the indentation 2-21 in the container part 2-3 has the effect that the container part 2-3 also has two leg parts 2-23 and 2-24 which delimit the indentation 2-22 on opposite sides, which abut against the outer sides of the auxiliary container part 2-22 when the container parts 2-2 and 2-3 are connected to one another and form the shaped body with a uniformly closed cross-section. Preferably in the connected state of the container parts 2-2 and 2-3, the leg parts 2-5 and 2-6 of the container part 2-2 are offset with respect to one another by 90° with respect to the leg parts 2-23 and 2-24 of the container part 2-3 when viewed in the circumferential direction of the container arrangement 2-1. When connecting the container parts 2-2 and 2-3, the auxiliary container part 2-21 serves as a guide for the container part 2-3.

It is pointed out that the configurations of the closure parts 2-10, 2-11, the lid parts 2-12, 2-21, the locking grooves 2-13, 2-14, 2-16, the locking projections 2-19, 2-20 and the fixing slopes 2-15 preferably correspond to the configurations of the corresponding elements of FIG. 4*a* to 4*d*. The corresponding other configurations in connection with the description of these figures are also feasible.

Figure 5A:
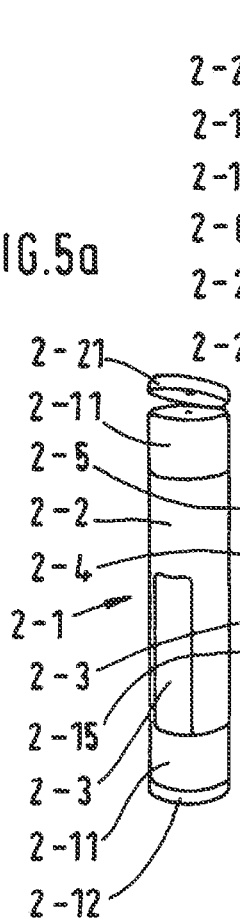
FIGS. 5*a* to 5*c* show a third preferred embodiment of the container arrangement according to the invention in which each container part has at least one recess for receiving a subregion of the respectively other container part.
Figure 5B:
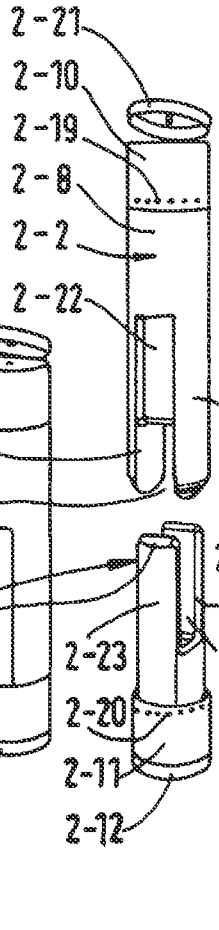
Figure 5C:
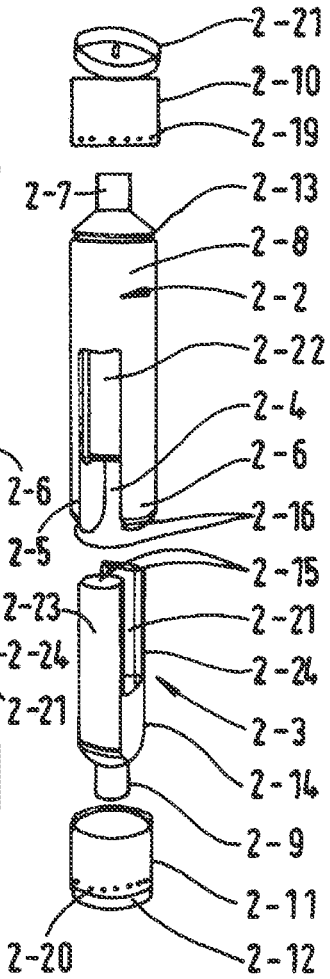

A further embodiment of the container arrangement 3-1 according to the invention which substantially corresponds to those of FIGS. 5*a* to 5*c* is explained hereinafter in connection with FIGS. 6*a* to 6*c*. The only difference from the container arrangement 2-1 is that each container part 3-2 and 3-3 has an auxiliary container part 3-22 or 3-25 (FIG. 6*c*) between its leg parts 3-5 and 3-6 or 3-23 and 3-24, each of which projects into the corresponding recess 3-4 or 3-21 between the leg parts 3-5 and 3-6 or 3-23 and 3-24 and at the same time forms the transverse parts connecting the respective leg parts 3-5 and 3-6 or 3-23 and 3-24. In this case, the auxiliary container parts 3-22 and 3-25 are preferably the same size so that the container arrangement 3-1 comprises two same-size container parts 3-2 and 3-3. In this way it is advantageously possible to produce the container parts 3-2 and 3-3 with the aid of one and the same mould, which is why appreciable costs can be saved. All the other elements which have already been explained in connection with FIGS. 5*a* to 5*c* (e.g. closure parts 3-10, 3-11, lid parts 3-12, 3-21, locking grooves 3-14, 3-16 and locking projections 3-19, 3-20) can be configured accordingly. The alternatives described above are also feasible. The leg parts 3-23, 3-24 of the container part 3-3 preferably have locking grooves 3-14 (or locking projections) at their end regions facing the container part 3-2, which cooperate with the locking projections (or locking grooves) of the closure part 3-10. Other locks, e.g. snap or screw connections are also feasible in this region.

Figures 6A, 6B, 6C:
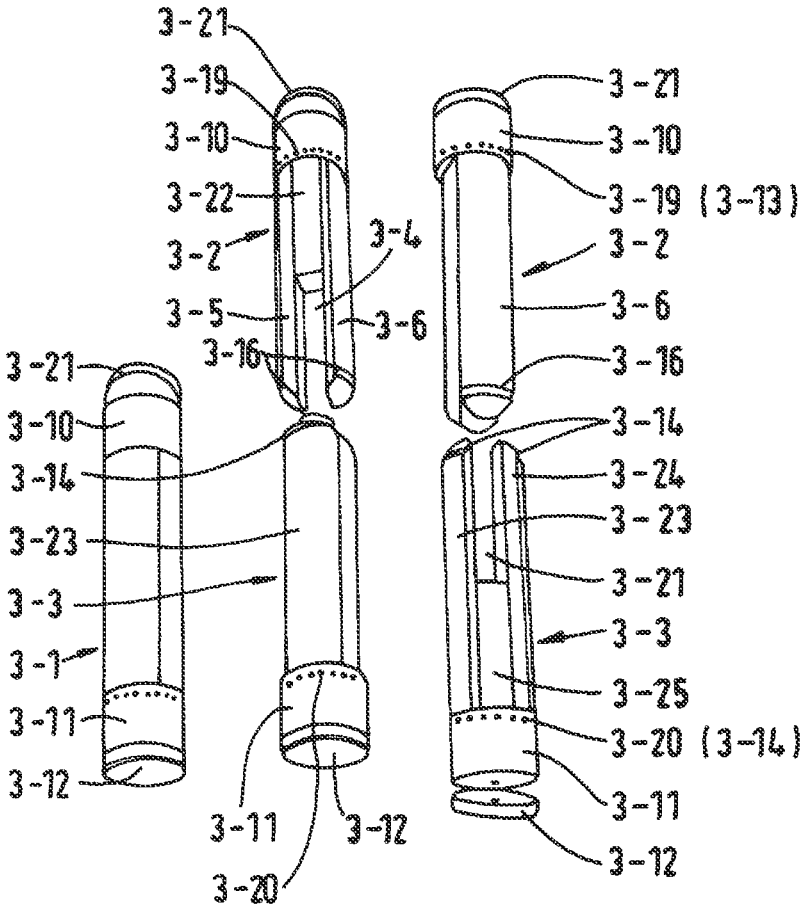
FIGS. 6*a* to 6*c* show a fourth preferred embodiment of the container arrangement according to the invention in which the two container parts are the same size and identical.
Figures 7A, 7B, 7C, 7D:
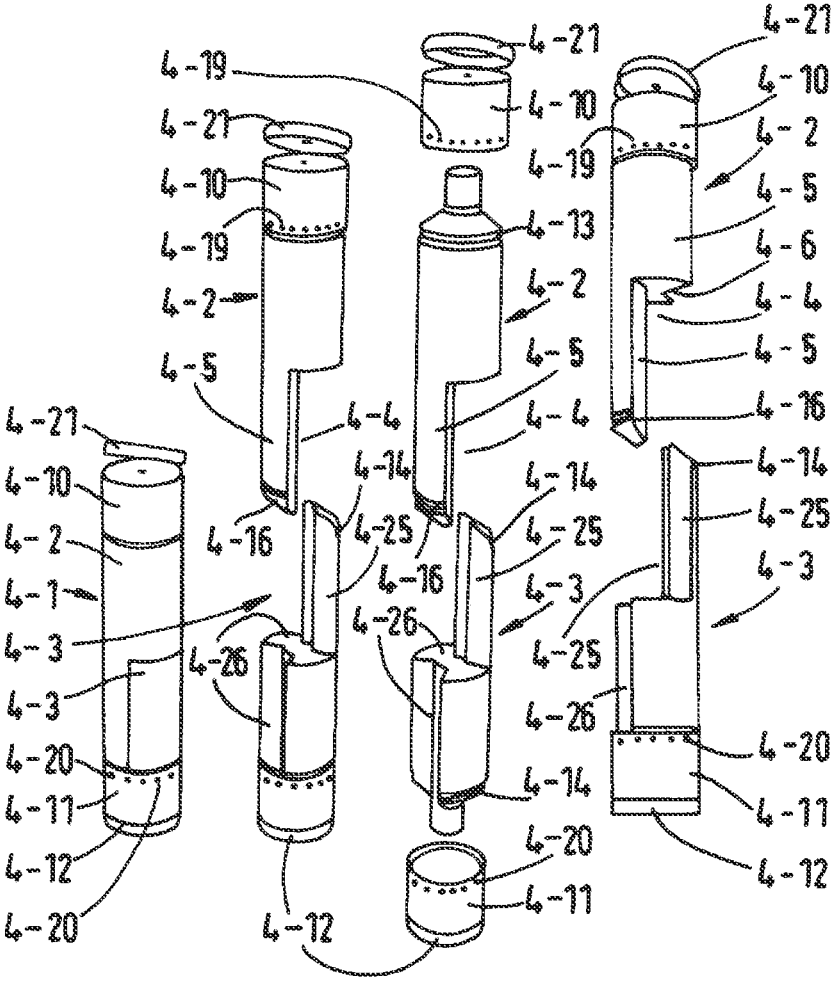
FIGS. 7*a* to 7*d* and FIGS. 8*a* to 8*d* show further developments of the invention.
Figures 8A, 8B, 8C, 8D:
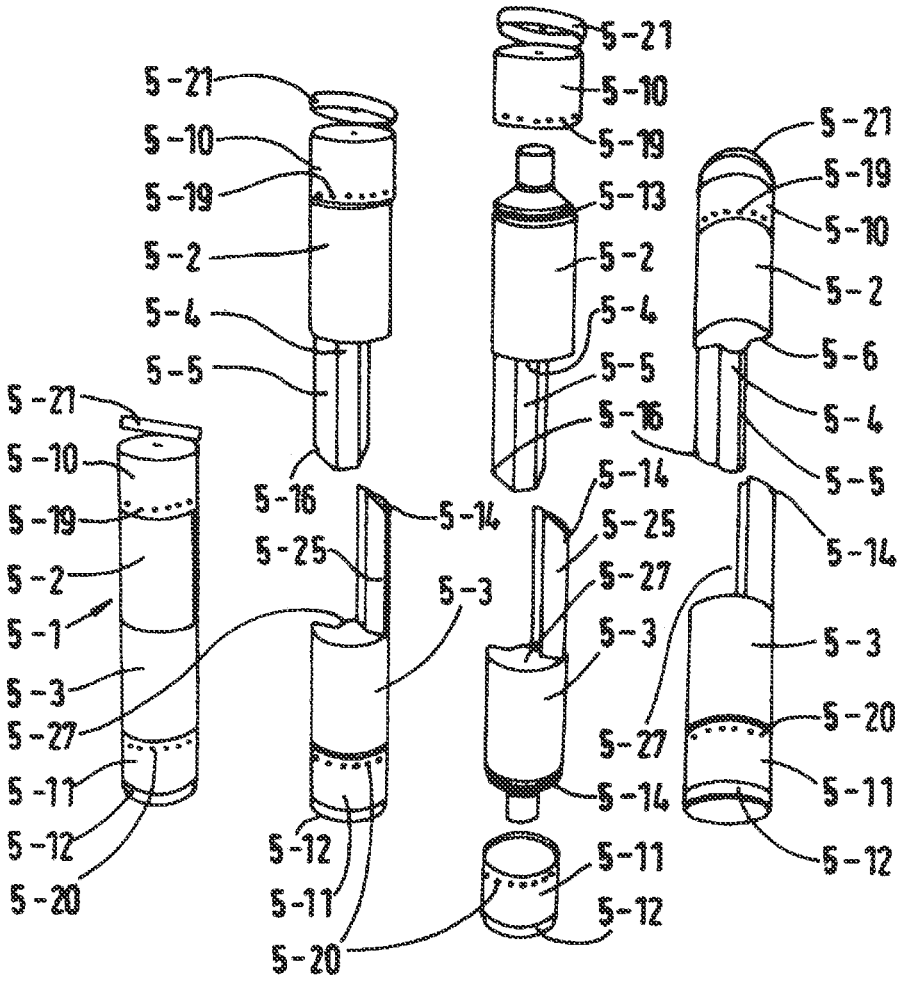

FIGS. 7*a* to 7*d* show another embodiment of the present container arrangement 4-1 which substantially corresponds to the embodiment of FIG. 6*a* to 6*c*, where however each container part 4-2 and 4-3 only has one leg part or one extension part 4-5 or 4-25. In this case, the extension parts 4-5 or 4-25 each project beyond the actual container part 4-2 or 4-3 in the longitudinal direction of the container arrangement 4-1. In addition to the extension part 4-5, the container part 4-2 forms or comprises a recess 4-4 for receiving the container part 4-3 and a further recess 4-6 (FIG. 4*d*) for receiving the extension part 4-25 of the container part 4-3. Accordingly, in addition to the extension part 4-25, the container part 4-3 forms or comprises a recess 4-26 for receiving the container part 4-2 and a further recess 4-26 (FIG. 4*b, c*) for receiving the extension part 4-5 of the container part 4-2. The end regions of the extension parts 4-5 and 4-25 have locking elements, preferably the locking grooves 4-16 or 4-14, which cooperate in the manner described further above with further locking elements, preferably the locking projections 4-19 or 4-20, All the other elements which have already been explained in connection with FIGS. 6*a* to 6*c* (e.g. closure parts 4-10, 4-11, the lid parts 4-12, 4-21, locking projections 4-19, 4-20, locking grooves 4-13, 4-14, 4-16) can be configured accordingly. The alternatives described above are also feasible.

Finally a container arrangement 5-1 similar to the preceding container arrangement 4-1 is explained with reference to FIG. 7*a* to 7*d* in which the extension parts 5-5 and 5-25 are not opposite in relation to the longitudinal axis of the container arrangement 5-1 but are offset by 90° with respect to one another. Details which have already been explained in connection with FIGS. 6*a* to 6*d* are designated in the corresponding manner where the respective reference numbers after the hyphen correspond identically.

An advantage of the further developments of the invention according to FIGS. 7*a* to 7*d* and 8*a* to 8*d* consists in that the two container parts 4-2, 4-3 or 5-2, 5-3 can each be configured identically so that they can be produced with one and the same mould which leads to appreciable cost savings. The leg parts and extension parts which have been explained are preferably suitable for receiving corresponding products.

The container arrangements according to the invention which have been explained preferably consist of a plastic material which can be processed by injection moulding.

There has thus been shown and described a novel container arrangement for a product which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A container arrangement for product, comprising a first independent container part having a closable first dispensing opening and a second independent container part having a closable second dispensing opening, wherein the second container part can be arranged detachably in a recess of the first container part; wherein the first container part and the second container part are connectable together to form the container arrangement; wherein, when connected, the first dispensing opening and the second dispensing opening point in different directions, such that a product in the first container part and a product in the second container part can be dispensed separately from one another; wherein the first dispensing opening is closable by a first closure part and the second dispensing opening is closable by a second closure part; wherein at least the second closure part overlaps a subregion of the second container part and a subregion of the first container part in a locking manner when the first and the second container parts are connected to one another; wherein the first container part has a first wall which partially delimits the recess for insertion of the second container part; wherein the second closure part has a second locking arrangement on a second wall thereof which acts in a locking manner on a first locking arrangement disposed at an end region of the first wall and on a third locking arrangement disposed on a second wall of the second container part when the second container part is inserted in the recess of the first container part and when the second closure part is disposed on the dispensing opening of the second container part; and wherein the first and second closure parts are independently openable when the first and second container parts are connected together, thereby to separately dispense contents of the first and second container parts through their respective first and second dispensing openings.

2. The container arrangement according to claim 1, wherein the first and second container parts form a uniformly closed cross-section when they are connected together.

3. The container arrangement according to claim 2, wherein the first and second container parts form a cylindrical cross section when they are connected together.

4. The container arrangement according to claim 1, wherein the first dispensing opening and the second dispensing opening are both circular and are disposed coaxially to one another.

5. The container arrangement according to claim 1, wherein the second locking arrangement of the second closure part has the form of at least one locking projection or locking groove disposed on the inner side of the second closure part, wherein the first locking arrangement of the first wall has the form of at least one locking groove or locking projection disposed on the outer side of the first wall and wherein the third locking arrangement on the second wall of the second container part has the form of at least one locking groove or locking projection disposed on the outer side of the second wall of the second container part.

6. The container arrangement according to claim 5, wherein the first part has a first wall which partially delimits a recess that extends from a side of the first closure part to a side of the second closure part and wherein the first closure part of the first container part comprises a locking arrangement which acts in a locking manner on a fourth locking arrangement disposed at the end region of the wall of the first container part and on a fifth locking arrangement disposed on a second wall of the second container part when the second container part is inserted in the recess of the first container part and when the first closure part is disposed on a dispensing opening of the first container part.

7. The container arrangement according to claim 1, wherein the second container part can be fastened in a first recess in the first container part by means of locking elements.

8. The container arrangement according to claim 7, wherein the locking elements are firmly bonded to the first and second container parts, respectively.

9. The container arrangement according to claim 1, wherein the first container part comprises first leg parts which delimit a first recess and that lie opposite to each other in relation to a longitudinal axis of the first container, and wherein the second closure part comprises a second locking arrangement which acts in a locking manner on a first locking arrangement disposed on end regions of the first leg parts and on a third locking arrangement disposed on the second container part when the second container part is inserted in the first recess of the first container part and when the second closure part is disposed on a dispensing opening of the second container part.

10. The container arrangement according to claim 9, wherein the second locking arrangement of the second closure part and the first locking arrangement of the first leg parts as well as the third locking arrangement of the second container part form a snap or screw closure.

11. The container arrangement according to claim 9, wherein the first container part has a first auxiliary container part between the first leg parts thereof which partially fills the first recess between the first leg parts of the first container part and which engages in an indentation of the second container part which is formed between a first one of the leg parts and a second one of the first leg parts that lie opposite to each other in relation to the longitudinal axis of the first container part when the first container part is connected to the second container part.

12. The container arrangement according to claim 11, wherein the second container part has a second auxiliary container part between second leg parts thereof, which partially fills a second recess between the second leg parts of the second container part and which engages in the recess of the first container part when the first container part is connected to the second container part.

13. The container arrangement according to claim 12, wherein the first closure part comprises a first locking arrangement which acts in a locking manner on the locking arrangements disposed on end regions of the second leg parts of the second container part and on the first container part when the second container part is inserted in the first recess of the first container part and when the first closure part is disposed on the dispensing opening of the first container part.

14. The container arrangement according to claim 1, wherein a first recess of the first container part into which the second container part can be inserted is disposed laterally next to a first extension part of the first container part, wherein the second container part has a second extension part which engages in a second recess of the first container part, wherein the first extension part of the first container part engages in a third recess of the second container part when the first container part and the second container part are connected to one another and wherein the first extension part of the first container part has a first locking arrangement on its end region facing the second closure part that acts in a locking manner on a second locking arrangement of the second closure part and wherein the second container part has a third locking arrangement which acts in a locking manner on a fourth locking arrangement of the second closure part when the second closure part the second container part disposed on the dispensing opening of the second container part.

15. The container arrangement according to claim 14, wherein the second extension part of the second container part has a fifth locking arrangement on its end region facing the first closure part which acts in a locking manner on the first locking arrangement of the first closure part and has a sixth locking arrangement on the first container part which acts in a locking manner on a seventh locking arrangement of the first closure part when the first closure part of the first container part is disposed on the dispensing opening of the first container part.

16. The container arrangement according to claim 15, wherein the fifth locking arrangement of the second container part has the form of at least one locking projection or locking groove disposed on the inner side of the second closure part, wherein the first locking arrangement of the first extension part of the first container part has the form of at least one locking groove or locking projection disposed on the outer sides of the first extension part of the first container part, wherein the first locking arrangement of the first closure part has the form of at least one locking projection or locking groove, disposed on the inner side of the first closure part, and wherein the locking arrangement of the second extension part of the second container part has the form of a locking groove or locking projection disposed on the outer sides of the second container part or on the outer side of the second extension part of the second container part, respectively.

17. The container arrangement according to claim 16, wherein the first and second extension parts lie opposite in relation to a longitudinal axis of the container arrangement when the first container part is connected to the second container part.

18. The container arrangement according to claim 16, wherein the first and second extension parts lie opposite in relation to a longitudinal axis of the container arrangement are offset with respect to one another by 90°.

19. The container arrangement according to claim 1, wherein the second container part has second fixing elements on a side thereof facing the first container part and the first container part has first fixing elements on a side thereof facing the second container part which prevent a displacement of the first and second container parts transversely to a longitudinal axis of the container arrangement.

20. The container arrangement according to claim 19, wherein the first and second fixing elements have the form of fixing slopes which abut against one another.

21. The container arrangement according to claim 19, wherein the first and second fixing elements have axially intermeshing projections and indentations.

* * * * *